US007691014B2

(12) United States Patent
Nye et al.

(10) Patent No.: US 7,691,014 B2
(45) Date of Patent: Apr. 6, 2010

(54) BASKETBALL SYSTEM

(75) Inventors: S. Curtis Nye, Clinton, UT (US); David C. Winter, Layton, UT (US)

(73) Assignee: Lifetime Products, Inc., Clearfield, UT (US)

( * ) Notice: Subject to any disclaimer, the term of this patent is extended or adjusted under 35 U.S.C. 154(b) by 764 days.

(21) Appl. No.: 11/331,496

(22) Filed: Jan. 12, 2006

(65) Prior Publication Data

US 2006/0194653 A1 Aug. 31, 2006

Related U.S. Application Data

(60) Provisional application No. 60/643,340, filed on Jan. 12, 2005, provisional application No. 60/690,702, filed on Jun. 15, 2005.

(51) Int. Cl.
*A63B 63/08* (2006.01)

(52) U.S. Cl. ..... 473/479; 473/481

(58) Field of Classification Search ..... 473/479, 473/480, 481; 108/301; 248/170; 40/218; D21/304, 305, 306
See application file for complete search history.

(56) References Cited

U.S. PATENT DOCUMENTS 3,041,032 A * 6/1962 Wilcox ..... 248/170
4,548,379 A * 10/1985 Seely et al. ..... 248/624
5,248,140 A 9/1993 Mower et al.
D351,879 S 10/1994 Matherne et al.
D351,881 S 10/1994 Taylor et al.
D351,882 S 10/1994 Taylor et al.
5,354,049 A 10/1994 Matherne et al.
5,375,835 A 12/1994 Van Nimwegen et al.
5,377,976 A * 1/1995 Matherne et al. ..... 473/483
5,556,088 A 9/1996 Mower et al.
5,573,237 A 11/1996 Van Nimwegen et al.
5,836,838 A 11/1998 Van Nimwegen et al.
5,919,102 A 7/1999 Smith et al.
5,947,847 A 9/1999 Van Nimwegen et al.
6,027,918 A 2/2000 Mitsuzumi et al.
6,432,003 B1 8/2002 van Nimwegen
6,656,065 B2 12/2003 Nye
6,916,257 B1 7/2005 van Nimwegen
7,044,867 B2 5/2006 van Nimwegen
7,118,500 B2 10/2006 Nye et al.
7,331,882 B1 * 2/2008 White ..... 473/481

OTHER PUBLICATIONS

News from CPSC, U.S. Consumer Product Safety Commission, Mar. 28, 2002, 4 pages.

(Continued)

*Primary Examiner*—Gene Kim
*Assistant Examiner*—M Chambers
(74) *Attorney, Agent, or Firm*—Workman Nydegger

(57) ABSTRACT

A basketball system may include a basketball goal and a support pole. The basketball system may also include a base and one or more braces connecting to the support pole and the base. The base is preferably spaced apart from the support pole by a distance and the base may have a low profile. The basketball goal may include a backboard and a rim assembly in which one or more portions of the rim assembly may extend through the backboard so that the rim assembly can be connected to the support pole.

29 Claims, 10 Drawing Sheets

OTHER PUBLICATIONS

*Hot Shots Sports Equipment: Netball Systems*; http://web.archive.org/web/20020305030955/http://www.hotshot-sports.com/netball.htm; Site Updated Dec. 3, 2001; Date Downloaded: May 7, 2007; 2 pages.

*OZ Ring: Play Hard*; http://web.archive.org/web/20040723143758/http://www.ozring.com.au/netball.php; Date Downloaded: May 7, 2007; 2 pages.

*Sweatband.com: Sure Shot 553 Easi Shot Portable Basketball Unit*; http://web.archive.org/web/20030726111412/www.sweatbandoutdoor.co.uk/shop/detail.asp?ProductGroupID=1261&ItemCount=1; © Copyright Sweatband, Ltd. 1999-2003; Date Downloaded: Jun. 19, 2007, 1 page.

*ProSportuk: Sure Shot 553 Easi Shot Portable Basketball Goal*; http://web.archive.org/web/20041014040040/www.prosportuk.com/details/16/77/625; Copyright © 2004, prosportuk.com; Date Downloaded: Jun. 19, 2007; 1 page.

*ProSportuk: Sure Shot 553 Easi Shot Portable Basketball Goal*; http://web.archive.org/web/20060227045841/http://www.prosportuk.com/detail/16/187/625: Copyright © 2006, prosportuk.com; Date Downloaded: Jun. 19, 2007; 1 page.

*Half Court Sports: First Team RollaSport II Portable Basketball Goal 48" Acrylic* Backboard; http://web.archive.org/web/20040214190717/http://www.halfcourtsports.com/First_Team_RollaSport_II.html; © 2003 HalfCourtSports.com; Date Downloaded: Jun. 16, 2007; 3 pages.

*Basketball-Goals.com: First Team: The Rollasport*; http://web.archive.org/web/20041209160643/http://www.basketball-goals.com/first-team-rollasport.htm; Date Downloaded: Jun. 16, 2007; 3 pages.

*Basketball-Goals.com: First Team: The Rollasport*; http://web.archive.org/web/20041210025408/www.basketball-goals.com/ROLLASPORT-details.htm; Date Downloaded: Jun. 16, 2007; 2 pages.

*Basketball-Goals.com: First Team: The Rollasport*; http://web.archive/org/web/20050303221526/http://www.basketball-goals.com/first-team-rollasport.htm; Date Downloaded: Jun. 16, 2007; 3 pages.

*Basketball-Goals.com: RollAbout Portable Serier: Assembly Instructions*; http://web.archive.org/web/20050304004537/http://www.basketball-goals.com/rollasportassemblyinstrcutions.htm; Date Downloaded: Jun. 16, 2007; 3 pages.

* cited by examiner

BASKETBALL SYSTEM

CROSS-REFERENCE TO RELATED APPLICATIONS

This application claims priority to, and the benefit of, U.S. provisional patent application 60/643,340, which was filed Jan. 12, 2005 and entitled PORTABLE BASKETBALL SYSTEM, and U.S. provisional patent application 60/690,702, which was filed Jun. 15, 2005 and entitled BASKETBALL GOAL SYSTEM, each of which are hereby incorporated by reference in their entireties.

BACKGROUND OF THE INVENTION

1. Field of the Invention

The present invention relates to a basketball system and, in particular, to a portable basketball system that is capable of being selectively moved from one location to another location.

2. Description of Related Art

The game of basketball typically includes a flat and level playing surface with a basketball goal at each end of the court. The basketball goal, which includes a backboard and a rim or hoop, is typically attached to the top of a support pole. The rim or hoop is normally located ten feet above the playing surface and the backboard is constructed from materials such as wood, plastic or tempered glass.

Basketball is a very popular game and many people desire to play basketball at their home. Many basketball systems designed for home use require the basketball goal be permanently fixed in a particular location. For example, many home basketball systems are permanently positioned on the edge of the driveway. Disadvantageously, mounting a basketball goal adjacent to the driveway of the home may create a risk of damage to cars using the driveway or cars that are parked nearby. In addition, one or more cars may have to be moved before the basketball goal may be used.

Permanent basketball systems designed for use at home may also be difficult to install. For example, concrete or asphalt may be located where it is desired to install the permanent basketball system. Accordingly, the concrete or asphalt may have to be removed and/or replaced to allow the basketball system to be installed. Undesirably, removing and/or replacing the concrete or asphalt may be difficult, time-consuming and expensive. In addition, this would most likely prevent use of the driveway during the period of construction and repair.

Permanent basketball systems that are installed at home are usually located outdoors and are exposed to the harsh elements of the weather throughout the entire year. Disadvantageously, when conventional permanent basketball systems are constantly exposed to the elements such as rain, snow, sleet, high temperatures and high humidity, various components of the basketball system may prematurely oxidize, corrode or rust. Premature oxidation, corrosion and rust can be particularly troublesome in basketball goal assemblies that have any moving parts, such as height adjustment mechanisms or breakaway rim assemblies. Moreover, constant exposure to the elements may cause failure of such mechanisms.

It is also known to use permanent basketball systems indoors. Indoor basketball systems, however, require a large amount of space and must be located away from other structures to allow basketball to be played. For example, conventional indoor basketball systems must generally be spaced several feet away from the walls so that the walls do not interfere while playing basketball. These permanent basketball systems may limit or prevent the space from being used for other purposes. For example, schools typically have a gymnasium and basketball goals may be located near the ends or sides of the gymnasium. The basketball goals may undesirably preclude or interfere with use of the gymnasium for other purposes. In addition, on formal occasions, objection may be made to the appearance of the permanently mounted basketball goals.

Portable basketball systems that are movable from one location to another location are also known. Conventional portable basketball systems typically require a large amount of weight so that the basketball goal remains in a generally rigid, upright position for use when playing basketball or shooting baskets. In particular, many conventional portable basketball systems require a large and heavy base to prevent the basketball system from undesirably moving. The large and heavy base, however, may make the basketball system very difficult to move and may require the assistance of several people to set up or relocate the basketball goal. Additionally, these known basketball system are often relatively expensive and that may prohibit people from using these systems at home.

Conventional portable basketball systems may use removable weights, such as sand bags or metal weights, which help maintain the basketball system in a fixed position. Disadvantageously, these removable weights can be extremely heavy, difficult to lift and hard to position in the desired location. Accordingly, although these basketball systems using removable weights may be easier to move in relation to permanently mounted goal assemblies, the weights or weighted members are often not easy to move, lift or position, which may limit the usefulness of the portable basketball system.

In an attempt to make portable basketball goal assemblies that are better suited for home use, large support bases with a hollow cavity for receiving ballast material, such as sand or water, were developed. These portable basketball systems may be moved into the desired location and then the support base may be filled with sand or water to add weight to the system, which would help prevent the system from undesirably moving during use. Disadvantageously, the large support bases of many conventional portable basketball systems were difficult to fill with sand or water. In addition, in order to move many of these portable basketball systems, the sand or water had to be removed and this may be very inconvenient and awkward.

The support bases for these known portable basketball systems were quite large because a large amount of weight was required to maintain the basketball system in a stationary position while playing basketball. Undesirably, the large size of the support base may significantly increase shipping costs because the base is typically transported within a large, bulky package. The large size of the support base may also increase storage costs because of the size of the packaging. Additionally, because the support bases for conventional portable basketball systems may be quite large, a considerable amount of material is required to construct the base, which may increase the cost of the portable basketball system. Further, the large support base may interfere with playing basketball because the players and/or basketball may strike or hit the base.

Many conventional basketball systems also include large and/or heavy parts, which can be difficult to install. In addition, these large parts may increase the size of the packaging, which can further increase shipping costs. Finally, some retail consumers may not have access to vehicles (such as trucks, sport utility vehicles, or the like) that can transport the large packaging and thus may choose not to purchase the basketball systems.

BRIEF SUMMARY OF THE INVENTION

A need therefore exists for a basketball system that eliminates or diminishes the disadvantages and problems described above.

One aspect is a basketball system that may include a support structure, such as a support pole. The support pole is preferably sized and configured to maintain a basketball goal above a playing surface. The basketball goal preferably includes a basketball backboard and a basketball rim, and may also include a net.

Another aspect is a basketball system that may be selectively moved from one location to another location. Desirably, the basketball system is a portable basketball system that is readily capable of being moved. Advantageously, the basketball system may be quickly and easily moved from one location to another, and the basketball system may be moved by a single person, if desired.

Yet another aspect is a basketball system that may include a base. The base may include a hollow interior portion that is sized and configured to receive ballast, such as sand or water. The base may also include a relatively large surface or outer portion upon which one or more weights may be placed. The base is preferably constructed of relatively lightweight materials, such as blow-molded plastic. The basketball system may also include a support pole and one or more braces, and the braces may interconnect the base and the support pole to help secure the support pole in a desired position. Also, the basketball system may include one or more wheels to help move the basketball system to a desired location.

A further aspect is a basketball system that may include a base that is spaced apart from a support pole. Advantageously, with such spacing, the base may not interfere with playing basketball. In addition, such spacing may help facilitate a stable basketball system. For example, such spacing may advantageously provide a longer moment arm that allows the base to provide a greater resistance to undesired movement of the basketball system. In addition, such spacing may provide a longer moment arm that allows a smaller base to provide substantially the same resistance to movement that a larger base may provide. Advantageously, the smaller base may be more efficient to store and to ship. The smaller base may also require less material to construct, making the basketball system less expensive to manufacture.

A still further aspect is a basketball system that may include a support pole and a base that includes one or more receiving portions which are sized and configured to receive and retain at least a portion of the support pole in a storage or shipping position. Advantageously, the receiving portions may make the basketball system more efficient to store and ship.

Another aspect is a basketball system that may be lightweight, which may facilitate shipping, transportation and storage of the basketball system. In addition, the basketball system may be packed within a relatively small, compact package, which may also facilitate shipping, transportation and storage of the basketball system. The relatively small, lightweight packaging may reduce costs, for example, when shipping the basketball system from the factory to the store. In addition, this may allow consumers to easily transport the system from the store to their house. Further, the basketball system may be simple to assembly because it has few parts and is lightweight.

Yet another aspect is a basketball system that may include a base that has a smaller size than a conventional base. For example, the basketball system may include a base that has a width and length that is approximately equal to or less than the width and length of the backboard. Advantageously, if the backboard and base have generally the same dimensions, then the backboard and base may be more easily disposed within the same package. In addition, this may allow the packaging to be smaller, which may result in decreased manufacturing, shipping and/or storage costs.

Still another aspect is a basketball system that may include a base with a height that is smaller than a conventional base. For example, the height of the base may be one-third, one-half or even smaller than the height of a conventional base. The decreased height of the base may result in decreased manufacturing, shipping and/or storage costs. Additionally, the base may have generally the same size as the backboard, which may facilitate packaging the base and backboard together. Further, the base may include textured surfaces to allow, for example, items to be placed on the base and/or increased contact with the playing surface.

A further aspect is a basketball system that may include a base with a generally planar upper surface, which may allow one or more objects to be placed on the base. For example, if the base has a very low height, then one or more weights to be easily placed on the base because the weights only have to be lifted a slight amount. In addition, this may allow one or more weights to be simply rolled onto the base. Further, the weights may be placed in a variety of suitable arrangements on the base and, if desired, only a portion of the weight may be placed on the base. Additionally, various types of weights may be used, such as weight plates, sand bags, water containers, and the like.

A still further aspect is a basketball system than may include a base with a relatively low profile. For example, the height of the base may be significantly less than either the width or the length of the base. For instance, the base may include a width of about two feet and a length of about three feet. The height of the base, however, may be much less than either the width or the length. In particular, the base may have a height of about six inches or less.

Yet another aspect is a basketball system that may include a rim assembly with a rim and one or more brackets or braces, which may increase the strength and/or stability of the rim. The brackets or braces may be selectively connected and disconnected to the rim assembly, as desired. This may allow the rim assembly to be packaged in an at least partially unassembled arrangement, which may facilitate packaging and/or storage of the basketball system. This may also allow the rim assembly to be disposed within relatively small packaging. In addition, the backboard may include one or more receiving portions, such as openings or cutouts, which may be sized and configured to receive at least a portion of the rim assembly. For example, the receiving portions may be sized and configured to receive a portion of the rim braces.

Another aspect is a basketball system that may include a rim assembly which includes a rim and a mounting member that is sized and configured to mount the rim to a structure such as the backboard or a support pole. For example, the backboard may include one or more receiving portions, such as openings or cutouts, which may be sized and configured to receive at least a portion of the mounting member. The receiving portions may allow the mounting member to be directly connected to the support pole.

Still another aspect is a basketball system that may include one or more elongated braces that connect the support pole to the base. Advantageously, the elongated braces may allow the base to be spaced apart from the support pole.

A still further aspect is a basketball system that may include one or more feet and/or wheels connected to the support pole. Advantageously, the feet may help maintain the basketball system in a generally fixed location. On the other hand, the wheels may facilitate movement of the basketball system. In greater detail, the feet and/or wheels may be directly connected to the support pole. The feet and/or wheels may also be connected to the base by one or more elongated braces.

These and other aspects, features and advantages of the present invention will become more fully apparent from the following detailed description of preferred embodiments and appended claims.

BRIEF DESCRIPTION OF THE DRAWINGS

The appended drawings contain figures of preferred embodiments to further illustrate and clarify the above and other aspects, advantages and features of the present invention. It will be appreciated that these drawings depict only preferred embodiments of the invention and are not intended to limit its scope. The invention will be described and explained with additional specificity and detail through the use of the accompanying drawings in which.

DETAILED DESCRIPTION OF THE PREFERRED EMBODIMENTS

The present invention is generally directed towards a basketball system. The principles of the present invention, however, are not limited to basketball systems. It will be understood that, in light of the present disclosure, the basketball system disclosed herein can be successfully used in connection with other types of structures or equipment.

Additionally, to assist in the description of the basketball system, words such as top, bottom, front, rear, right and left may be used to describe the accompanying figures, which are not necessarily drawn to scale. It will be appreciated, however, that the basketball system can be located in a variety of desired positions—including various angles, sideways and even upside down. A detailed description of the basketball system now follows.

Figure 1:
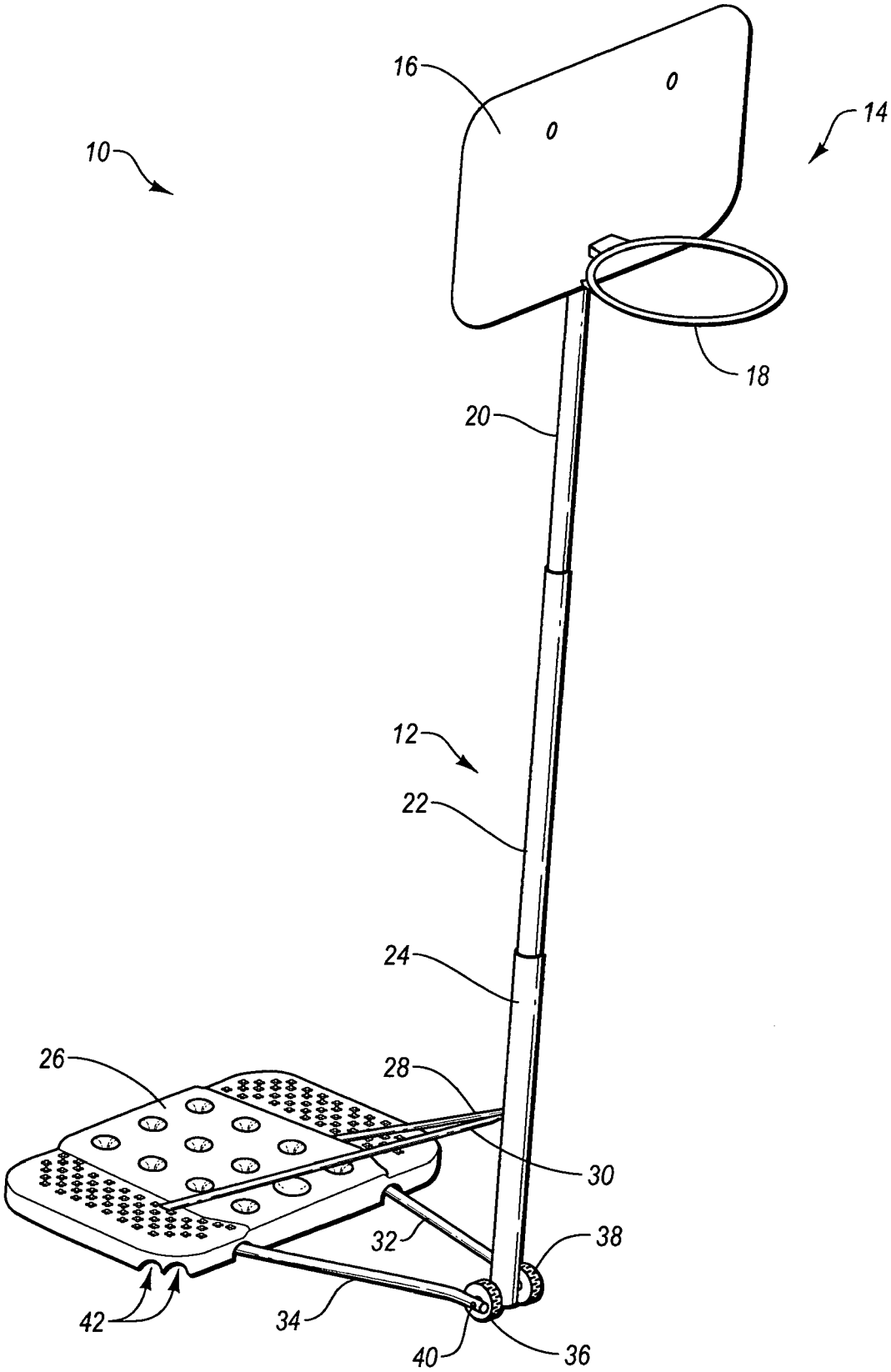
FIG. 1 a perspective view of an exemplary basketball system.

As shown in FIG. 1, a basketball system 10 may include a support pole 12 or other support structure. The support pole 12 is preferably sized and configured to maintain a basketball goal 14 above a playing surface. The basketball goal 14 may include a basketball backboard 16, a basketball rim 18 and a net, if desired.

The support pole 12 may include one or more support members 20, 22, 24. As shown in FIG. 1, the support members 20, 22, 24 are plurality of slidably or otherwise movably coupled. For example, the support pole 12 may include support members 20, 22, 24 that are telescopically coupled. It will be appreciated that the support pole 12 may include a plurality of interconnected components or it may consist of a single component.

The basketball system 10 may be a portable basketball system with a base 26. The base 26 is preferably constructed from plastic and it may be formed by blow-molding, injection molding or the like. The base 26 may include a hollow interior portion, which may be sized and configured to receive ballast, such as sand or water. The base 26, however, could be constructed from other materials with appropriate characteristics and it does not require a hollow interior portion.

The basketball system 10 may include braces 28, 30, 32, 34 that connect the base 26 and the support pole 12. The braces 28, 30, 32, 34 are preferably elongated so that the base 26 is spaced apart from the support pole 12. Also, the basketball system 10 may include wheels 36, 38 to help move the basketball system to a desired location. The basketball system 10 may also include other features and aspects, such as disclosed in U.S. Pat. No. 6,432,003, filed Aug. 14, 2000, entitled ADJUSTABLE WHEEL ENGAGEMENT ASSEMBLY FOR BASKETBALL GOAL SYSTEMS; and U.S. Pat. No. 6,656,065, filed Jan. 16, 2002, entitled WHEEL MOUNTED ADJUSTABLE ROLLER SUPPORT ASSEMBLY FOR A BASKETBALL GOAL SYSTEM, which are incorporated by reference in their entireties. In addition, it will be appreciated that while the basketball system 10 is described and shown in connection with a portable basketball system, the basketball system could also be part of a fixed or permanent basketball system. Further, it will be appreciated that the system 10 could be used in connection with other types of systems and/or sports, such as volleyball.

Figure 2:
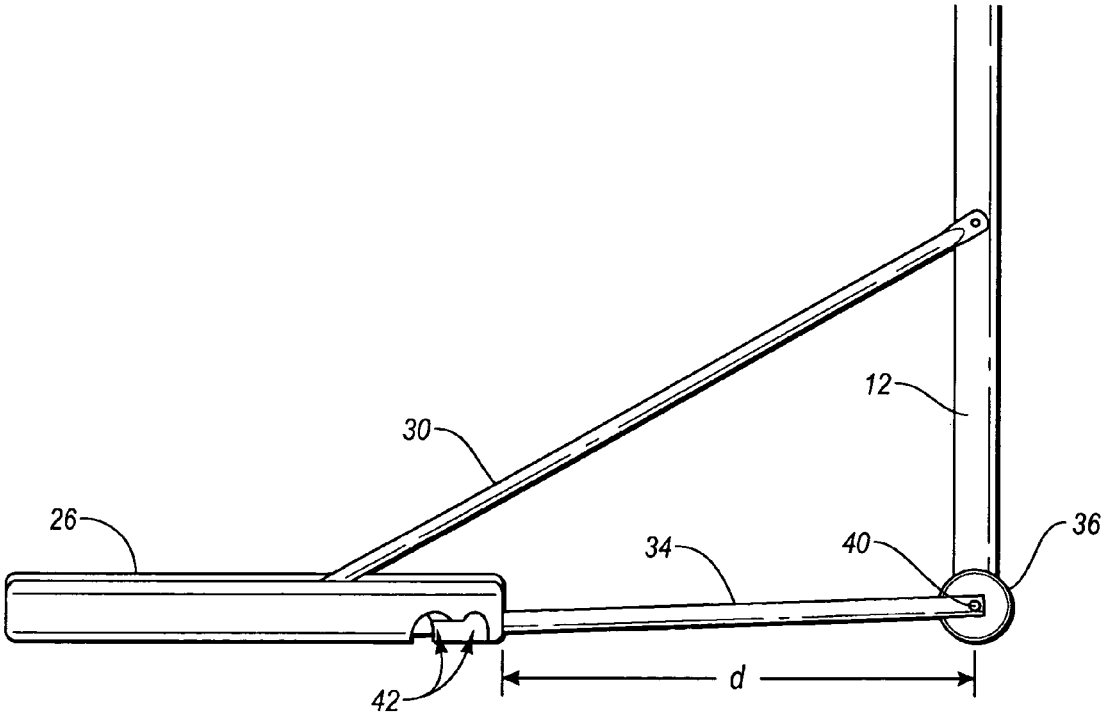
FIG. 2 is an enlarged side view of a portion of the basketball system shown in FIG. 1.

As shown in FIGS. 1 and 2, the basketball system 10 may include an axle 40 to interconnect the wheels 36, 38 and the support pole 12. The wheels 36, 38 and the axle may facilitate moving or positioning the basketball system 10 in desired locations. In particular, the basketball system 10 may be pivoted or rotated about the axis to facilitate moving the basketball system. As shown in the accompanying figures, the braces 32, 34 may be connected to the axle 40, but the braces could also be connected to the support pole 12.

As shown in FIGS. 1 and 2, the base 26 may be spaced apart from the support pole 12 and/or the wheels 36, 38. For example, as shown in FIG. 2, the base 26 may be spaced apart a distance d from the pivot point or axis. The base 26 is preferably spaced between about 2 to 3 feet (61 centimeters to 91 centimeters) apart from the support pole 12 and/or the wheels 36, 38. The base 26, however, may be spaced apart at lesser distances from the support pole 12 and/or the wheels 36, 38, such as about 2 to 3 inches (5.1 to 7.6 centimeters), 6 inches (15.2 centimeters), 1 foot (30.5 centimeters) or more. In addition, the base 26 may be spaced apart at greater distances from the support pole 12 and/or the wheels 36, 38. Advantageously, if the basketball system 10 may be pivoted or rotated about the axle 40 to facilitate moving the basketball system, then this point may also be spaced apart from the base 26.

Because the base 26 may be spaced apart from the support pole 12; the wheels 36, 38; and/or the point of rotation of the system 10 to facilitate movement, the base 26 may help create a relatively stable basketball system 26. For example, such spacing may provide a longer moment arm that allows the base 26 to resist undesired movement of the basketball system 10. In addition, such spacing may provide a longer moment arm that allows a smaller base 26 to be used to resist movement of the basketball system 10. The smaller base 26 may be more efficient to store, ship and construct.

As best seen in FIG. 2, the base 26 may have a low profile. For example, the base 26 may include a height that is less than or equal to about the diameter of the wheels 36, 38. The base 26 may also have a height that is less than or equal to about 8 inches (20.3 centimeters). In addition, the base 26 may have a height that is between about 3 to 5 inches (7.6 centimeters to 12.7 centimeters), such as about 4 inches (10.2 centimeters). In addition, the base 26 could be spaced apart from the support pole a distance d that is greater than the height of the base. In particular, the distance d separating the base 26 and the support pole 12 is one or more times the height of the base. For instance, the distance d could be equal to two or more times the height of the base 26. One of ordinary skill in the art will appreciate that the base 26 may have a larger or smaller height. It will also be appreciated that the base 26 need not be spaced apart from the support pole 12; the wheels 36, 38; and/or the point of rotation depending, for example, upon the design or intended use of the basketball system 10.

Figure 3:
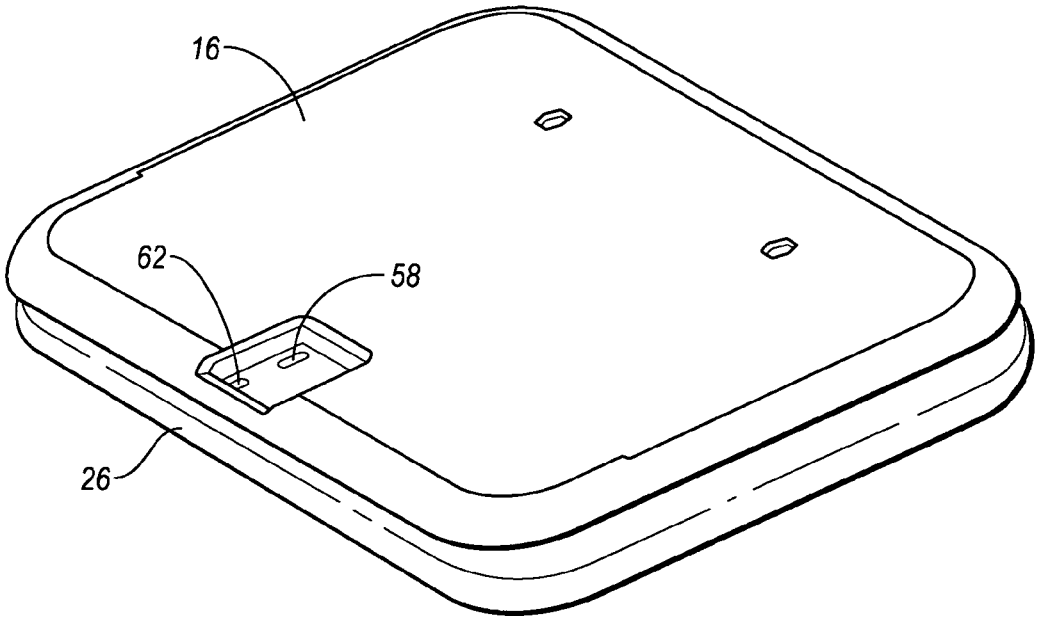
FIG. 3 is a perspective view of a portion of the basketball system shown in FIG. 1, illustrating the backboard and the base.

As best seen in FIG. 3, the base 26 and the backboard 16 preferably have about the same configuration. For example, both the base 26 and the backboard 16 may have a generally rectangular configuration. Thus, the base 26 may have a length and a width that are respectively approximate equal to or less than the length and width of the backboard 16. Further, the base 26 and the backboard 16 may have approximately the same thickness. These features may allow the base 26 and the backboard 16 to efficiently packaged, stored and/or shipped. It will be appreciated, however, that the base 26 and the backboard 16 may have a variety of other suitable shapes, sizes and configurations, if desired.

Figure 4:
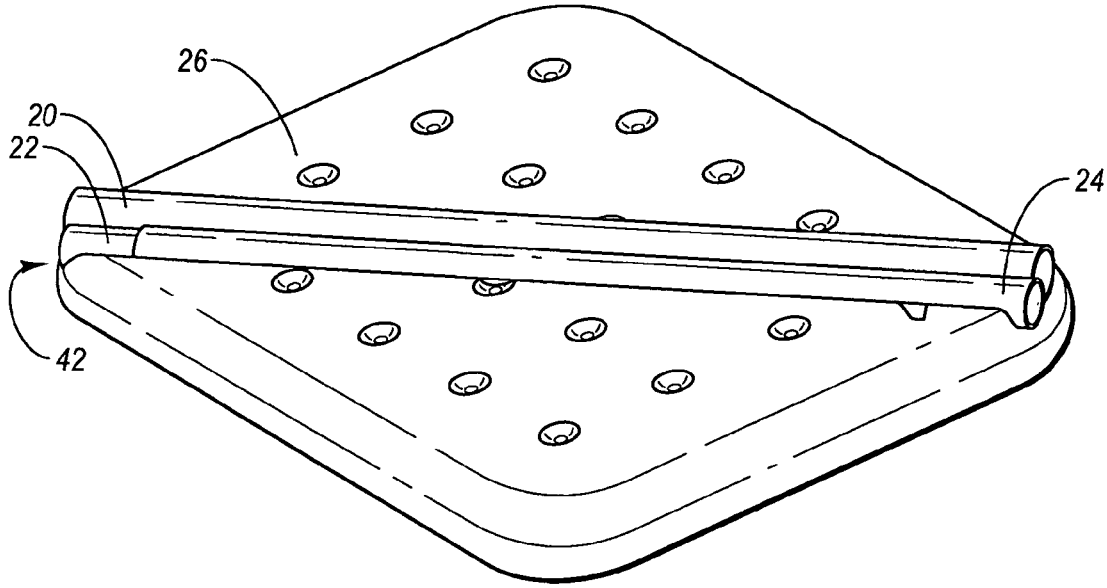
FIG. 4 is a perspective view of a portion of the basketball system shown in FIG. 1, illustrating receiving portions in the base and a portion of a support member disposed in one of the receiving portions.

As shown in FIGS. 1, 2 and 4, the base 26 may include one or more receiving portions 42 that are preferably sized and configured to receive and/or retain at least a portion of the support pole 12, which may make the basketball system 10 more efficient to store and/or ship. In particular, the receiving portions 42 are preferably sized and configured to receive and/or retain at least a portion of one or more of the support members 20, 22, 24 of the support pole 12. The receiving portions 42 may receive and retain the supports members 20, 22, 24 using, for example, a snap fit, a friction fit and/or an interference fit. In addition, two or more of the support members 20, 22, 24 may be telescopically nested or collapsed, such as the support members 22, 24 shown in FIG. 4. Advantageously, the receiving portions 42 may be integrally formed in the base 26 as a part of a unitary, one-piece structure during the manufacturing process.

Figure 6:
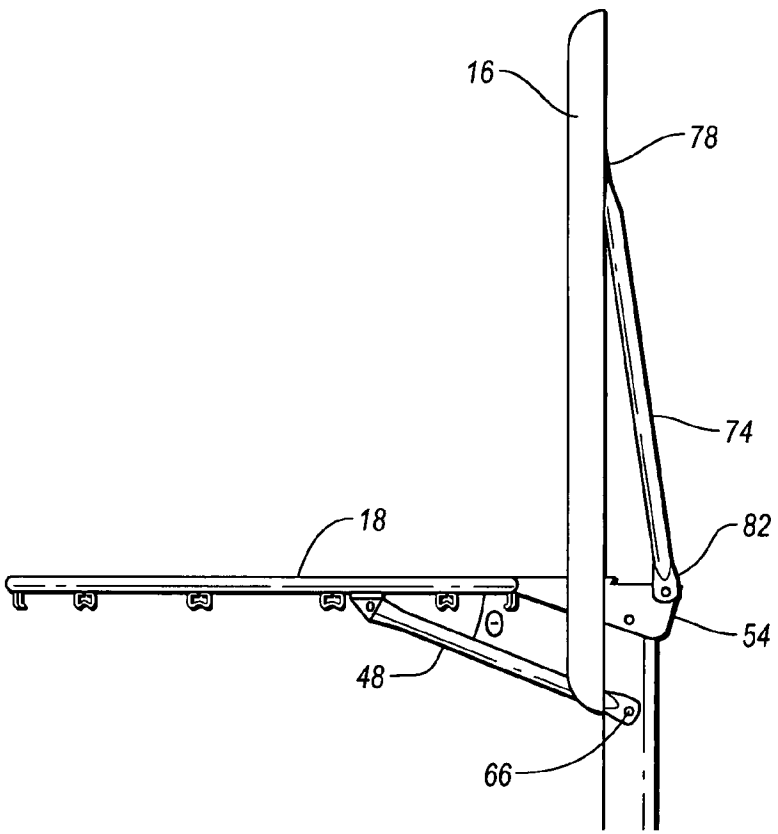
FIG. 6 is a right side view of a portion of the basketball system shown in FIG. 1.
Figure 7:
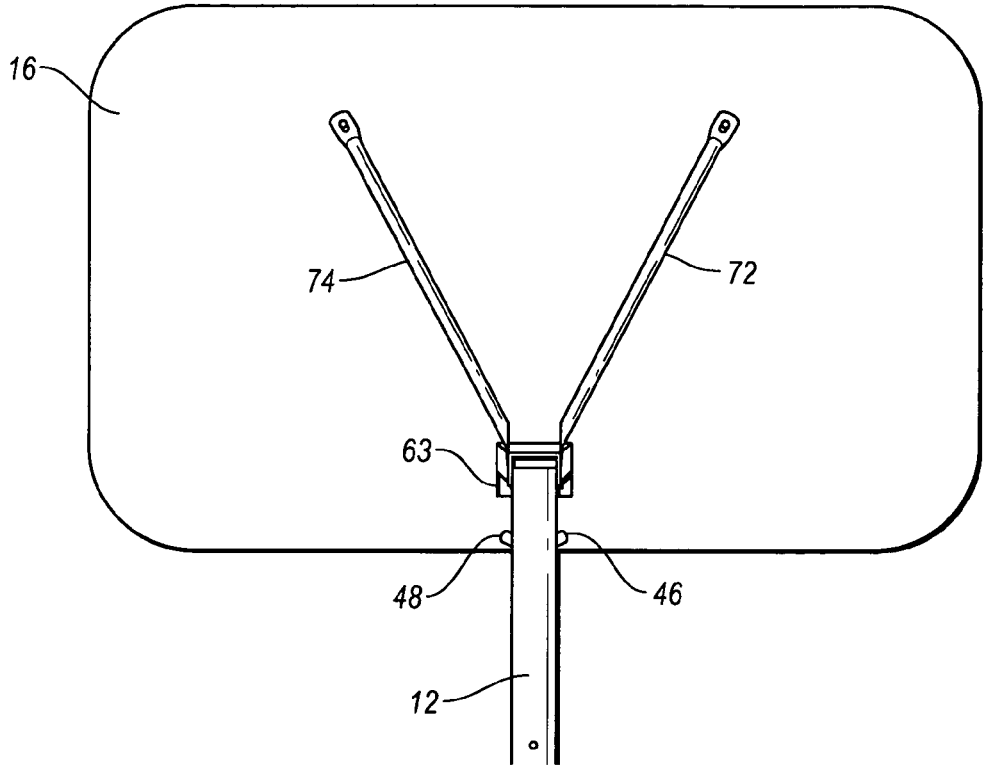
FIG. 7 is rear view of a portion of the basketball system shown in FIG. 1.
Figure 8:
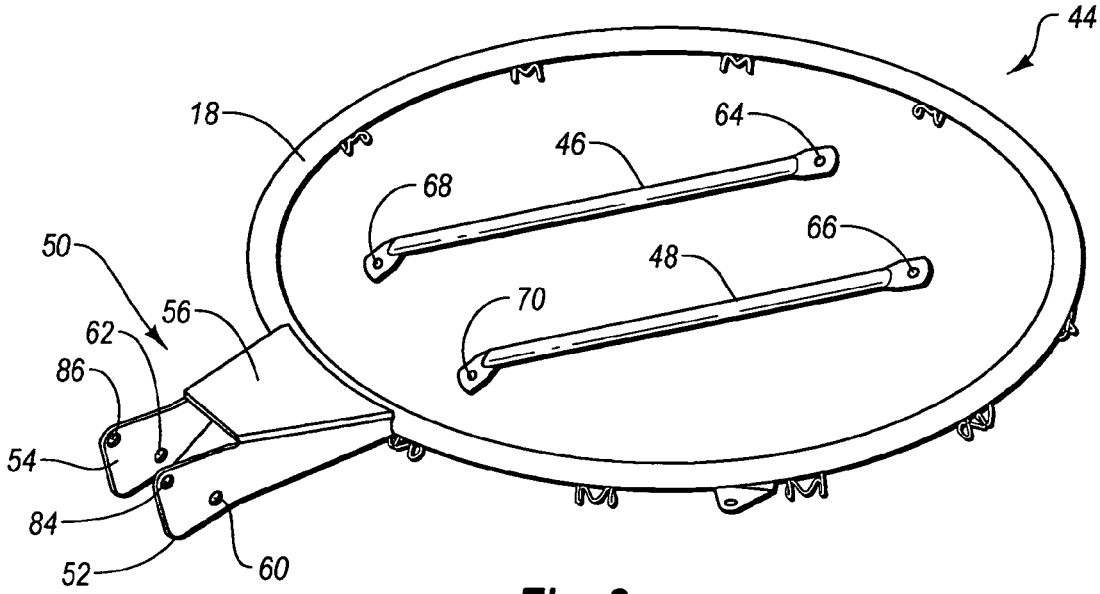
FIG. 8 is a perspective view of an exemplary rim assembly of the basketball system.
Figure 9:
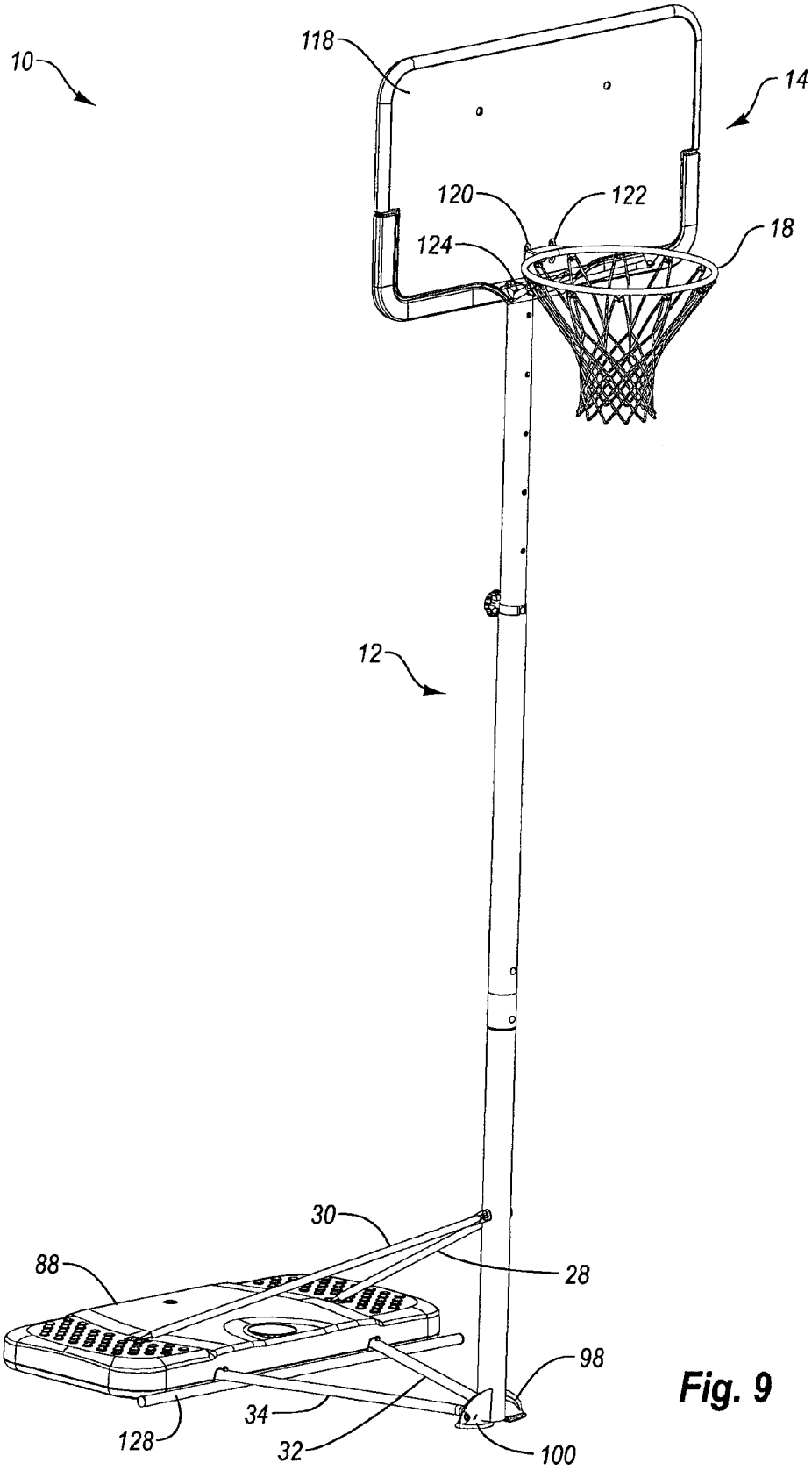
FIG. 9 is a perspective view of another exemplary basketball system.
Figure 10:
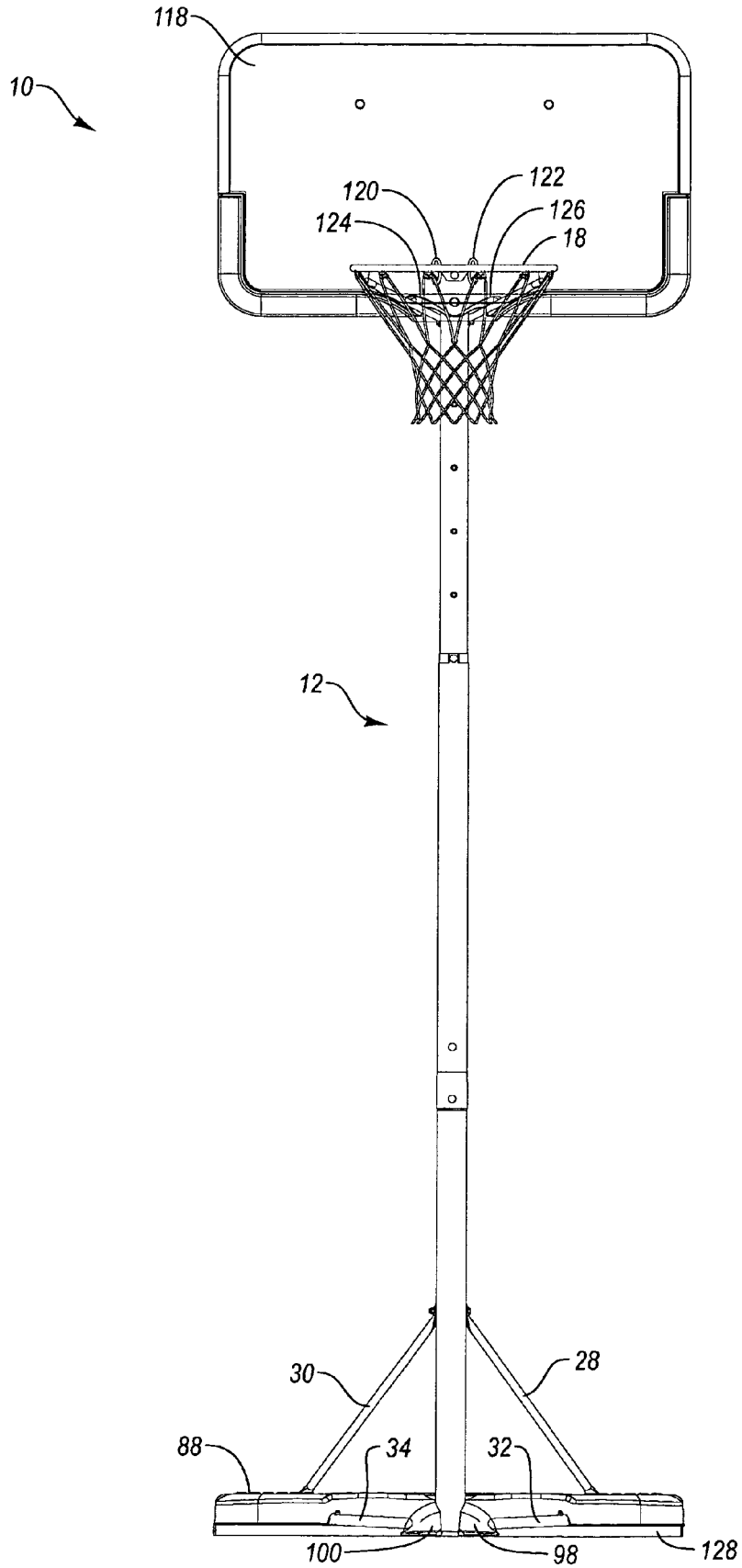
FIG. 10 is a front view of the basketball system shown in FIG. 9.

As shown in FIGS. 1 and 5-8, the basketball system 10 may include a rim assembly 44, which includes the rim 18. As best seen in FIG. 8, the rim assembly 44 may include a plurality of discretely formed components, which may allow the components to be packaged in an at least partially unassembled arrangement, such as shown in FIG. 8. The unassembled arrangement may allow the components to be placed within smaller packaging, which may make storage and shipping more efficient. In addition, the components of the rim assembly 44 are desirably sized and configured to be quickly and easily assembled by a retail purchaser. Advantageously, because a retail purchaser may at least partially assemble the rim assembly 44, the manufacturer need not completely assemble the rim assembly. It will be appreciated, however, that the manufacturer may completely assemble the rim assembly 44 depending upon, for example, the particular configuration of the basketball system.

As shown in FIGS. 1 and 5-8, the rim assembly 44 may include rim braces 46, 48, which may be sized and configured to increase the strength and/or stability of the rim 18. As shown in FIG. 8, the rim braces 46, 48 are desirably sized and configured to be quickly and easily attached to the rim 18 and/or the support pole 12. It will be appreciated, however, that the rim braces 46, 48 may be integrally formed with the rim 18 and that the rim assembly 44 does not require any rim braces.

As shown in FIG. 8, the rim assembly 44 may include a mounting member 50 that is preferably sized and configured to mount the rim 18 to a structure such as the backboard 16 or support pole 12. The rim braces 46, 48 and mounting member 50 are preferably attached using fasteners (such as bolts, rivets, screws, and the like), adhesives, welding, etc.

In greater detail, as shown in FIGS. 1 and 5-8, the mounting member 50 may include left side flange 52, a right side flange 54, and an upper plate 56. The flanges 52, 54 of the mounting member 50 are preferably sized and configured to be connected to the support pole 12. In particular, as shown in FIG. 3, the backboard 16 may include receiving portions, such as openings, slots, indentations and the like, that are sized and configured to receive one or more portions of the mounting member 50, such as the flanges 52, 54 and/or the plate 56. At least a portion of the flanges 52, 54 and/or the plate 56 may be inserted through the openings 58. In addition, a flange (not shown) may be attached to a part of the mounting member 50 (such as the upper plate 56), and the flange may be attached to a rear portion of the backboard 16 to help strengthen and/or reinforce the backboard.

As shown in FIGS. 1 and 5-8, the flanges 52, 54 may include one or more openings 60, 62 that are sized and configured to allow the mounting member 50 to be connected to the support pole 12. It will be appreciated that the flanges 52, 54 and the plate 56 may be connected to other suitable portions of the basketball system 10, if desired. It will also be appreciated that the mounting member 50 does not require the flanges 52, 54 or the plate 56 and that the mounting member may have a variety of other suitable sizes, shapes and/or configurations depending, for example, upon the intended use of the basketball system 10.

The rim braces 46, 48 are preferably sized and configured to be connected to the rim 18 and a support structure such as the backboard 16 or the support pole 12. In particular, as shown in FIG. 3, the backboard 16 may include one or more receiving portions, such as openings, slots, indentations and the like, that are sized and configured to receive a portion of the rim braces 46, 48. For example, a portion of the rim braces 46, 48 may be inserted through the openings 62.

As shown in FIG. 7, the backboard 16 may include a receiving portion 63 that is sized and configured to receive a portion of the mounting member 50 such as the flanges 52, 54; the plate 56; and/or the rim braces 46, 48. If desired, a portion of the flanges 52, 54; the plate 56; and/or the rim braces 46, 48 may be inserted through the receiving portion 63.

As shown in FIGS. 1 and 5-8, the rim braces 46, 48 may include openings 64, 66 that are sized and configured to receive to connect the rim braces to the support pole 12. In addition, the rim braces 46, 48 may include one or more openings 68, 70 that are sized and configured to receive fasteners to connect the rim braces to the rim 18. It will be appreciated that the rim braces 46, 48 may be connected other suitable portions of the basketball system 10 using fasteners, adhesives, welding and the like.

Figure 5:
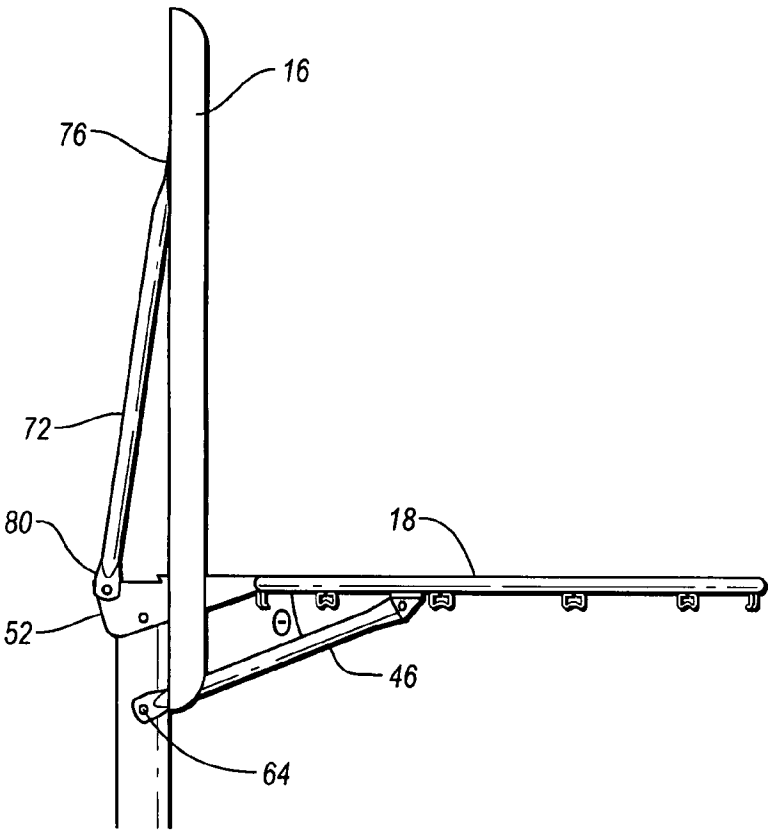
FIG. 5 is a left side view of a portion of the basketball system shown in FIG. 1.

As shown in FIGS. 5-6 and 8, the rim braces 46, 48 may be positioned in a generally fixed position at an angle θ relative to the rim 18. Advantageously, the angle θ may be sized to allow the rim braces 46, 48 to provide greater stability and/or strength to the rim 18. For example, the rim braces 46, 48 may be positioned at angle relative to the rim 18 that is between about 21 to 23 degrees. The rim braces 46, 48 are preferably positioned at angle relative to the rim 18 that is at least about 20 degrees, 45 degrees or more. However, the rim braces 46, 48 may be positioned at other suitable angles relative to the rim 18 depending, for example, upon the particular configuration of the rim assembly 44.

As shown in FIGS. 5-7, the basketball system 10 may include one or more braces 72, 74 that are connected to the backboard 16 and the support pole 12 and/or the rim assembly 44. The braces 72, 74 are preferably constructed from metal tubing with a generally circular cross-section, but the braces may have a variety of other suitable shapes and configurations, and the braces may be constructed from other materials with appropriate characteristics.

In greater detail, the braces 72, 74 may include a first portion 76, 78 that is sized and configured to be connected to the backboard 16 and a second portion 80, 82 that is sized and configured to be connected to the rim assembly 44. In particular, as shown in FIG. 8, the flanges 52, 54 of the mounting member 50 of the rim assembly 44 may include openings 84, 86 that receive fasteners which are sized and configured to connect the braces 72, 74 to the flanges 52, 54. It will be appreciated that the braces 72, 74 may be connected to other suitable portions of the basketball system 10, if desired.

As shown in FIGS. 9-15, another exemplary configuration of the basketball system 10 may include a base 88. The base 88 may include one or more recessed portions 90, 92 that may be sized and configured to receive at least a portion of wheels 94, 96 respectively. The wheels 94, 96 are preferably disposed proximate a rear portion of the base 88 and may be connected to the base using one or more axles and/or other suitable structures. The wheels 94, 96 may facilitate movement of the basketball system 10 into a desired location.

As shown in FIGS. 9-15, the basketball system 10 may include feet 98, 100. The feet 98, 100 may be connected to the support pole 12 and/or the braces 32, 34. Advantageously, the feet 98, 100 may contact, abut and/or engage the ground or other support surface. The feet 98, 100 may also be sized and configured to space the support pole 12 apart from the ground or support surface. It will be appreciated that the basketball system 10 may include feet with other suitable configurations and arrangements, such as a single foot or multiple feet.

Figure 14:
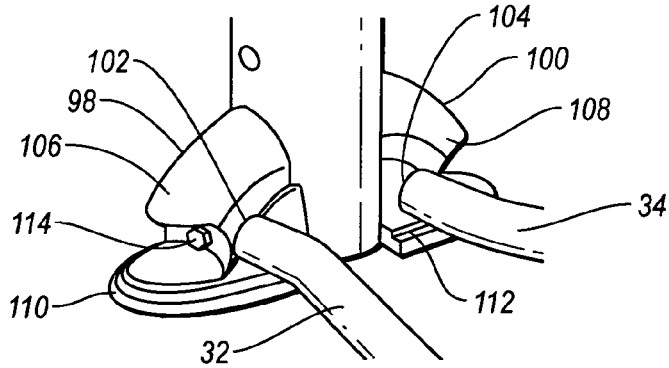
FIG. 14 is an enlarged perspective view of a portion of the basketball system shown in FIG. 9.
Figure 15:
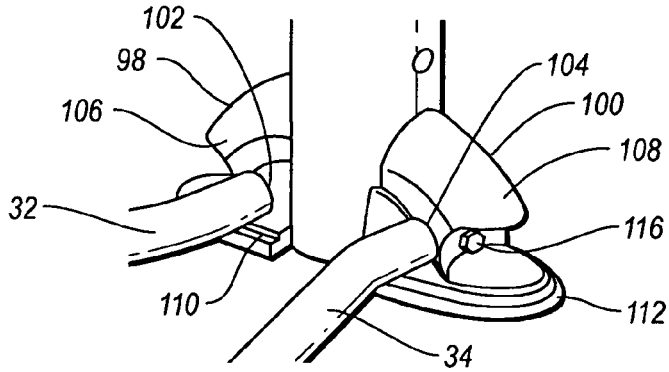
FIG. 15 is an enlarged perspective view of a portion of the basketball system shown in FIG. 9.

As best shown in FIGS. 14 and 15, the foot 98 may include a receiving portion 102 that is sized and configured to receive a portion of the brace 32, and the foot 100 may include a receiving portion 104 that is sized and configured to receive a portion of the brace 34. The feet 98, 100 may include an upper first portion 106, 108 and a lower second portion 110, 112. The upper portions 106, 108 and the lower portions 110, 112 may form at least a part of the receiving portions 102, 104. It will be appreciated that a foot may comprise a plurality of interconnected components and that a foot may consist of a single component.

The upper and lower portions 106, 108, 110, 112 may be sized and configured to grip the braces 32, 34. For example, the upper portions 106, 108 may clamp together with the lower portions 110, 112, respectively, to grip a portion of the braces 32, 34 within the receiving portions 102, 104. Fasteners 114, 116 may be used to help clamp the upper portions 106, 108 together with the lower portions 110, 112. In addition, the fastener 114 may be used to interconnect the upper portion 106 of the foot 98, the lower portion 110 of the foot 98, the brace 32 and/or the support pole 12; and the fastener 116 may be used to interconnect the upper portion 108 of the foot 100, the lower portion 112 of the foot 100, the brace 34 and/or the support pole 12. If desired, a single fastener may be used to interconnect the upper portion 106 of the foot 98, the lower portion 110 of the foot 98, the brace 32, the support pole 12, the upper portion 108 of the foot 100, the lower portion 112 of the foot 100, and/or the brace 34. It will be understood that the feet 98, 100 and the braces 32, 34 could have other suitable configurations and arrangements, and could be connected in other suitable manners, depending, for example, upon the intended use of the basketball system.

Figure 11:
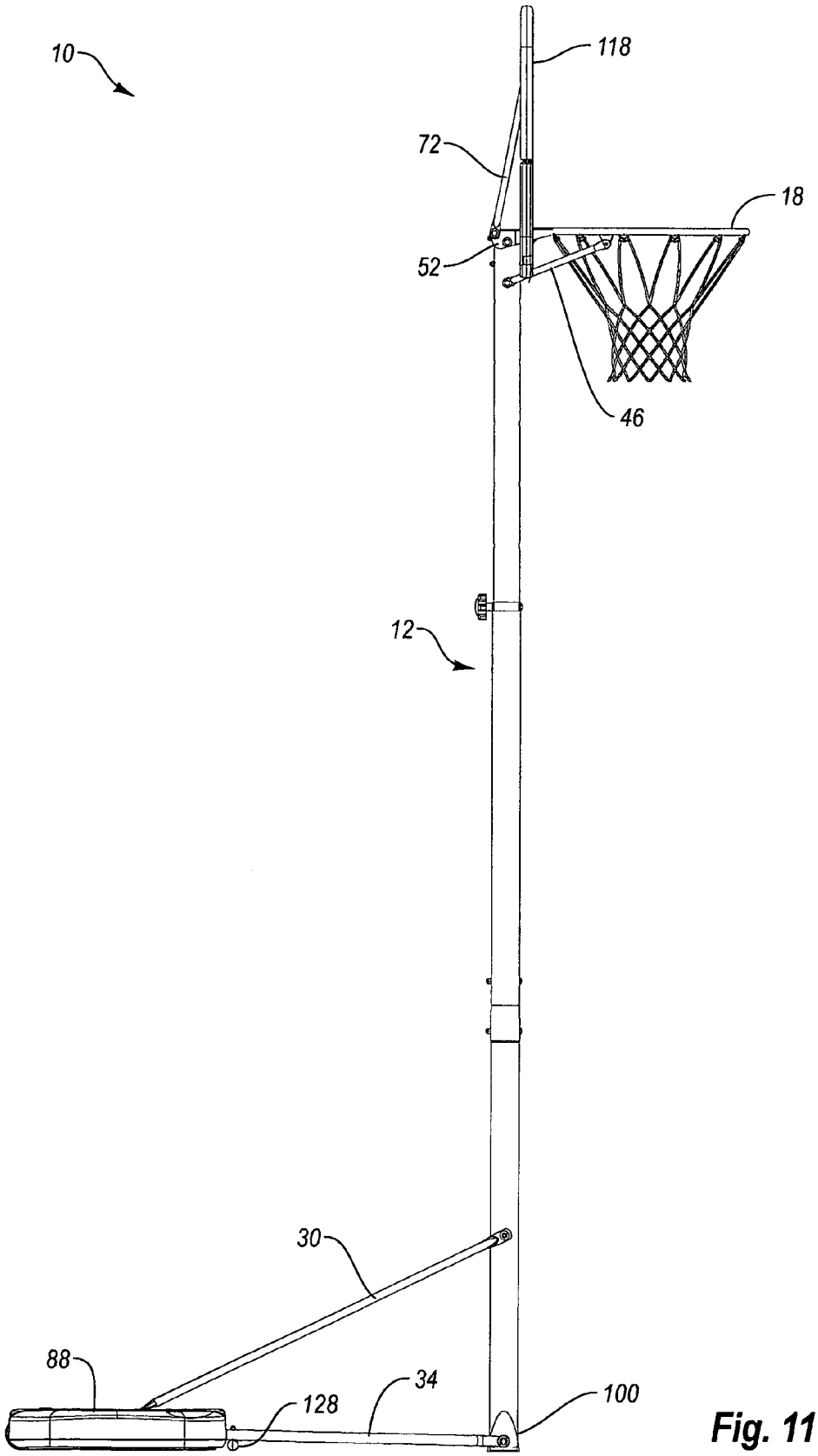
FIG. 11 is a side view of the basketball system shown in FIG. 9.
Figure 12:
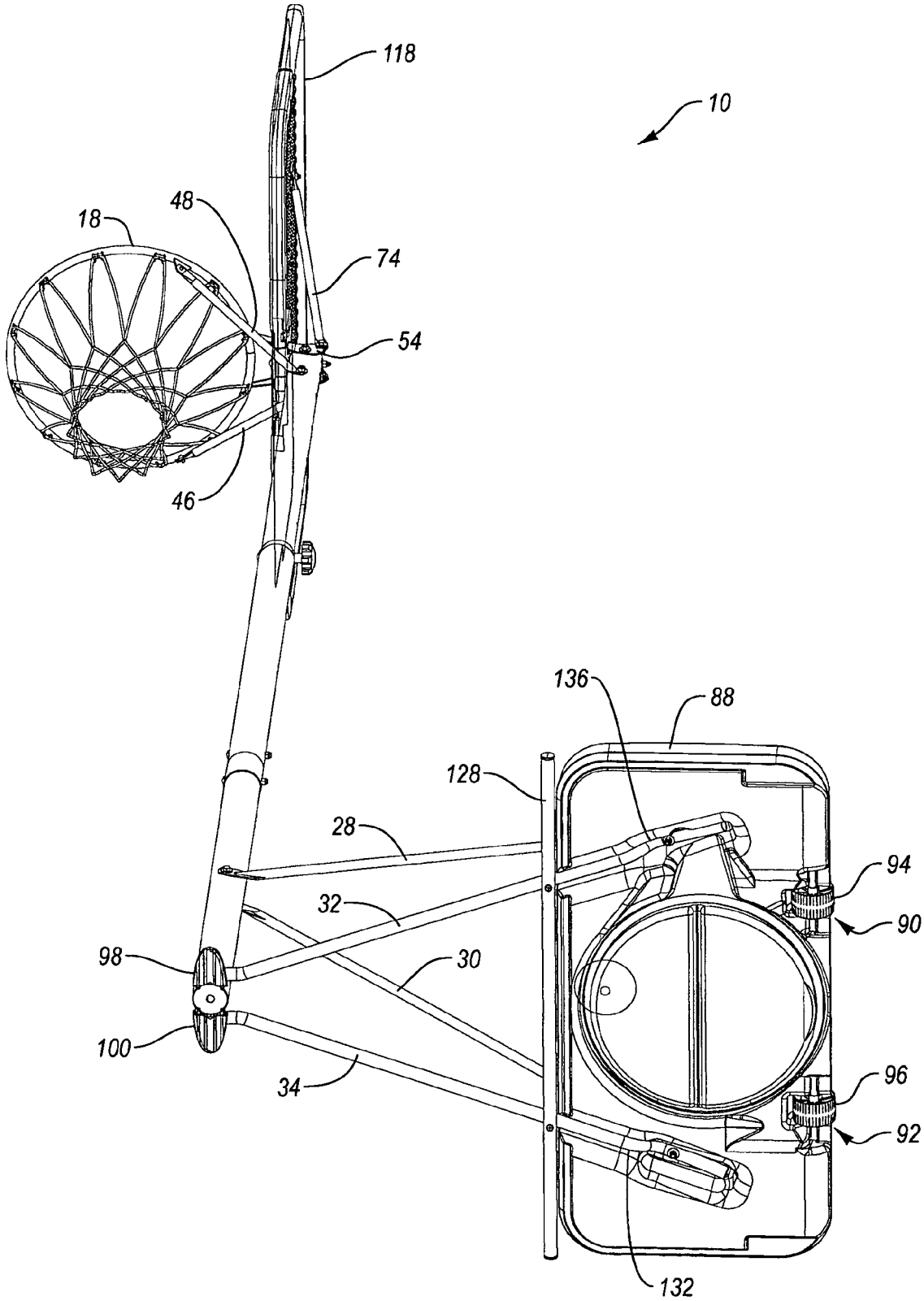
FIG. 12 is a bottom perspective view of the basketball system shown in FIG. 9.
Figure 13:
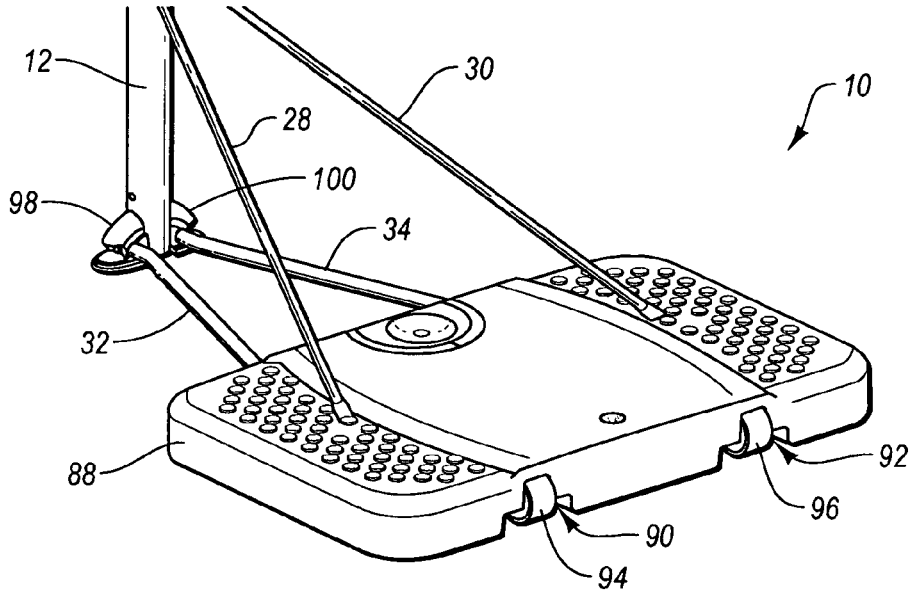
FIG. 13 is a perspective view of a portion of the basketball system shown in FIG. 9.

As shown in FIGS. 9-12, the basketball system 10 may include a backboard 118. The backboard 118 may include receiving portions 120, 122 that may be sized and configured to receive one or more portions of the mounting member 50, such as the flanges 52, 54. At least a portion of the flanges 52, 54 may be inserted through the receiving portions 120, 122 and may be connected to the support pole 12, as shown in FIGS. 11-12. The receiving portions 120, 122 preferably include openings, such as slots, that extend through the backboard 118 but the receiving portions may have other suitable configurations.

The backboard 118 also may include one or more receiving portions 124, 126 that may be sized and configured to receive portions of the rim assembly 44, such as the rim braces 46, 48. A portion of the rim braces 46, 48 may be inserted through the receiving portions 124, 126 and connected to the support pole 12, as shown in FIGS. 11 and 12. The receiving portions 124, 126 may include indentations or cutouts that may be disposed in a lower portion of the backboard 118, but the receiving portions may have other suitable configurations and may be disposed in other suitable locations.

As shown in FIGS. 9-12, the basketball system 10 may include a brace 128 that is connected to the braces 32, 24, which may help stabilize and/or reinforce the braces 32, 34. For example, the brace 128 may consist of an elongated tube or rod that is connected to the braces 32, 34 proximate the base 88. The brace 128 may help position the braces 32, 34 in the desired locations and it may help prevent the braces 32, 34 from undesirably moving. The brace 128 may also help connect the braces 32, 34 to the base 88. The basketball system 10, however, does not require the brace 128.

As shown in FIG. 12, the base 88 may include one or more receiving portions sized and configured to receive and/or retain a portion of the braces 32, 34. In particular, receiving portions 130, 132 may be sized and configured to receive and/or retain a portion of the braces 32, 34, respectively, using a snap fit, a friction fit, and/or an interference fit. The receiving portions 130, 132 are preferably disposed in a lower surface of the base 88. It will be appreciated, however, that the receiving portions 130, 132 may be disposed in other suitable locations.

The components of the basketball system 10 may be constructed of a variety of materials. For example, the backboard 16; the bases 26, 88; the wheels 38, 40; and the feet 98, 100 may be constructed from materials such as plastic. The support pole 12; the support members 20, 22, 24; the braces 28, 30, 32, 34, 72, 74, 128; the rim 18; the rim braces 46, 48; and the mounting member 50 may be constructed from materials such as metal. Advantageously, if the backboard, bases, wheels, and feet are constructed from plastic, then these components may be relatively lightweight and long-lasting. The support pole, support members, braces, rim, rim braces and mounting member are preferably constructed from metal because it is strong and durable. It will be appreciated that these and other components of the basketball system 10 may be constructed from other materials with other suitable characteristics. In addition, while the plastic components are preferably constructed from injection or blow-molded plastic, these and other components may be constructed from other processes.

The components of the basketball system 10 may also be integrally formed as part of unitary, one-piece structures during, for example, a molding process or other suitable manufacturing process. For example, the backboard 16 and/or the bases 26, 88 may be integrally formed as part of unitary, one-piece backboard or base during a blow molding process; and the blow-molded backboard or base may include a hollow interior portion formed during the blow molding process. Also, for example, the wheels 38, 40; and/or the feet 98, 100 may be integrally formed as part of unitary, one-piece wheel or foot during an injection molding process. Integrally forming these items as part of unitary, one-piece structure may advantageously help reduce manufacturing time and, thus, the costs associated with that manufacturing time. It will be appreciated that the backboard 16; the bases 26, 88; the wheels 38, 40; and/or the feet 98, 100 need not be integrally formed as part of any unitary, one-piece structure and may include a plurality of separately formed components formed via a variety of manufacturing processes.

The basketball system 10 may be quickly and easily assembled. For example, the support pole 12 may be quickly and easily attached to the basketball goal 14. In addition, the support pole 12 may be quickly and easily attached to the base 26 or 88. Ballast material may then be placed within the base 26 or 88 to help maintain the basketball system 10 in a generally fixed location. Ballast material may also be placed on the upper surface of the base 26 or 88, which preferably has a relatively large, planar surface. For example, sand bags, bricks and the like may be easily placed on the upper surface of the base 26 or 88. This may allow the basketball system 10 to be used by either placing ballast inside and/or on the upper surface of the base 26 or 88.

In order to move the basketball system 10, the ballast inside and/or on the upper surface of the base 26 or 88 may be removed, if desired. The basketball system 10 may then be tilted or pivoted upon the wheels 38, 40 or 94, 96 to facilitate movement. Significantly, if the basketball system 10 is not pivoted or tiled upon its wheels 38, 40 or 94, 96, then the basketball system may be held in a generally stationary and fixed position. For example, the feet 98, 100 and/or the lower surface of the base 26 or 88 may contact the support surface to hold the basketball system may be held in a generally stationary and fixed position. Of course, the ballast may also help maintain the basketball system in a generally stationary and fixed position.

Although this invention has been described in terms of certain preferred embodiments, other embodiments apparent to those of ordinary skill in the art are also within the scope of this invention. Accordingly, the scope of the invention is intended to be defined only by the claims which follow.

What is claimed is:

1. A basketball system comprising:

a basketball goal including a backboard and a rim;

a support pole connected to the basketball goal;

a base including a height and a hollow interior portion that is sized and configured to receive ballast, the base being spaced apart from the support pole by a distance that is generally equal to or greater than a height of the backboard, the base having a generally low profile; and a brace connecting the base and the support pole wherein the base has a generally rectangular configuration with a width and a length; wherein the backboard has a generally rectangular configuration with a width and a length; wherein the width and the length of the base is generally equal to the width and the length of the backboard.

2. The basketball system as in claim 1, wherein the distance separating the base and the support pole is at least twelve inches.

3. The basketball system as in claim 1, wherein the distance separating the base and the support pole is at least twice as large as the height of the base.

4. The basketball system as in claim 1, wherein the height of the base is approximately equal to a thickness of the backboard.

5. The basketball system as in claim 1, further comprising a foot connected to the support pole and to the brace proximate a bottom end of the support pole.

6. The basketball system as in claim 5, wherein the foot includes a receiving portion sized and configured to receive a portion of the brace.

7. The basketball system as in claim 1, wherein the rim of the basketball goal is directly connected to the support pole by a mounting member and the base is directly connected to the support pole by the brace.

8. The basketball system as in claim 1, wherein the base has a height that is between about three inches and about five inches.

9. The basketball system as in claim 1, wherein the base has a height that is less than about eight inches.

10. The basketball system as in claim 1, wherein the base has a length and a width;

wherein the backboard has a length and a width;

wherein the length of the base is less than or generally equal to the length of the backboard; and wherein the width of the base is less than or generally equal to the width of the backboard.

11. A basketball system comprising:

a support pole including an upper portion and a lower portion;

a basketball goal connected to the upper portion of the support pole, the basketball goal comprising:

a backboard including a receiving portion; and a rim assembly including a rim, a portion of the rim assembly being sized and configured to extend through the receiving portion of the backboard and be directly connect to the support pole;

a brace including a first portion and a second portion, the first portion of the brace being connected to the lower portion of the support pole; and a base connected to the second portion of the brace, the base being spaced apart from the support pole by a distance that is generally equal to or greater than a height of the backboard, the base being sized and configured to support the basketball goal above a playing surface wherein the base has a generally rectangular configuration with a width and a length; wherein the backboard has a generally rectangular configuration with a width and a length; wherein the width and the length of the base is generally equal to the width and the length of the backboard.

12. The basketball system as in claim 11, wherein the rim assembly includes a rim, a mounting member, and a rim brace.

13. The basketball system as in claim 12, wherein a portion of the rim brace is sized and configured to extend through the receiving portion and connect to the support pole.

14. The basketball system as in claim 12, wherein a portion of the mounting member is sized and configured to extend through the receiving portion and connect to the support pole.

15. A basketball system comprising:

a support pole;

a basketball goal including a backboard, a rim, a rim mounting member and a rim brace, the rim mounting member being attached to the rim and the support pole, the rim brace being attached to the rim and the support pole;

a backboard brace connected to the backboard and the rim mounting member; and a base connected to the support pole by one or more elongated members so that the base is spaced apart from the support pole by a distance that is generally equal to or greater than a height of the backboard wherein the base has a generally rectangular configuration with a width and a length; wherein the backboard has a generally rectangular configuration with a width and a length; wherein the width and the length of the base is generally equal to the width and the length of the backboard.

16. The basketball system as in claim 15, wherein the backboard includes a first receiving portion, a first portion of the rim mounting member being sized and configured to extend through the first receiving portion and be connected to the support pole.

17. The basketball system as in claim 16, wherein the backboard includes a second receiving portion, a second portion of the rim mounting member being sized and configured to extend through the second receiving portion and be connected to the support pole.

18. The basketball system as in claim 15, wherein the base is connected to the lower portion of the support pole by two elongated members, a length of each of the elongated members being generally equal to or larger than a width or a length of the base.

19. The basketball system as in claim 18, further comprising a connecting member connecting the two elongated members proximate the base.

20. A basketball system comprising:

a basketball goal;

a support structure that is sized and configured to support the basketball goal above a playing surface;

a base including a hollow interior portion that is sized and configured to receive ballast, the base being independent from and spaced apart from the support structure by a distance that is generally equal to or greater than a height of the backboard; and a first set of one or more braces connecting the base and the support structure, the first set of braces allowing the base and the support structure to be spaced apart by the distance and wherein the base has a generally rectangular configuration with a width and a length; wherein the backboard has a generally rectangular configuration with a width and a length; wherein the width and the length of the base is generally equal to the width and the length of the backboard.

21. The basketball system as in claim 20, further comprising a second set of one or more braces connecting the base and the support structure, the second set of braces being disposed at an angle relative to the first set of braces.

22. The basketball system as in claim 21, wherein the first set of braces are disposed generally parallel to and aligned with a lower portion of the base; and wherein the second set of braces are disposed at an upwardly extending angle relative to the lower portion of the base.

23. The basketball system as in claim 21, wherein a first end of the first set of braces is connected to a lower end of the support structure and a second end of the first set of braces is connected to a lower portion of the base.

24. The basketball system as in claim 20, wherein the basketball goal includes a backboard with a height, a width and a thickness; and wherein the base has a length that is generally equal to the height of the backboard, a width that is generally equal to the width of the backboard and a height that is generally equal to the thickness of the backboard.

25. The basketball system as in claim 20, wherein the base has a generally planar lower surface and a generally planar upper surface that are disposed in generally parallel planes.

26. The basketball system as in claim 20, wherein the distance separating the base and the support structure is generally equal to a width of the base.

27. The basketball system as in claim 20, wherein the distance separating the base and the support structure is generally equal to a length of the base.

28. The basketball system as in claim 20, wherein the distance separating the base and the support structure is generally equal to a height of the base.

29. The basketball system as in claim 20, wherein the distance separating the base and the support structure is generally equal to twice a height of the base.

* * * * *